US005651538A

United States Patent [19]

Chung et al.

[11] Patent Number: 5,651,538

[45] Date of Patent: Jul. 29, 1997

[54] PAPER FEEDING METHOD OF AN IMAGE FORMING APPARATUS

[75] Inventors: Kwang-Young Chung, Suwon; Sang-Won Cheong, Seoul; Dong-Ho Lee, Suwon, all of Rep. of Korea

[73] Assignee: SamSung Electronics Co., Ltd., Suwon, Rep. of Korea

[21] Appl. No.: 551,280

[22] Filed: Oct. 31, 1995

[30] Foreign Application Priority Data

Nov. 2, 1994 [KR] Rep. of Korea ..... 1994-28691

[51] Int. Cl.[6] ..... B65H 3/44; B65H 7/02

[52] U.S. Cl. ..... 271/9.02; 271/9.09; 271/258.03; 271/258.04

[58] Field of Search ..... 271/9.02, 9.09, 271/10.03, 10.11, 258.01, 258.03, 258.04, 9.04, 9.13, 259, 265.01

[56] References Cited

U.S. PATENT DOCUMENTS

| | | | |
|---|---|---|---|
| 4,786,920 | 11/1988 | Igarashi | 271/9.09 X |
| 4,878,087 | 10/1989 | Sakai et al. | 271/258.03 X |
| 4,935,780 | 6/1990 | Yamada et al. . | |
| 5,008,715 | 4/1991 | Imaizumi et al. . | |
| 5,095,370 | 3/1992 | Takada et al. . | |
| 5,171,006 | 12/1992 | Naito | 271/9.09 |
| 5,216,472 | 6/1993 | Muto et al. . | |
| 5,290,021 | 3/1994 | Murooka et al. | 271/9.09 |
| 5,384,631 | 1/1995 | Matsunami . | |

FOREIGN PATENT DOCUMENTS

| | | | |
|---|---|---|---|
| 246036 | 9/1992 | Japan | 271/9.09 |

*Primary Examiner*—Boris Milef

*Attorney, Agent, or Firm*—Robert E. Bushnell, Esq.

[57] ABSTRACT

A paper feeding method for an image forming apparatus having a sensing device for sensing the feeding state of paper fed from a manual paper feeding device and an automatic paper feeding device includes the steps of: picking up and feeding paper from the automatic paper feeding device in response to a printing command during an automatic paper feeding mode; determining whether or not a predetermined time period has elapsed after picking up the paper; determining whether the sensing device senses a paper input before the predetermined time period has elapsed; and providing output of an error message indicating a paper feeding error state when the sensing device senses the paper before the predetermined time period has elapsed.

20 Claims, 9 Drawing Sheets

PAPER FEEDING METHOD OF AN IMAGE FORMING APPARATUS

CROSS-REFERENCE TO RELATED APPLICATIONS

This application makes reference to, incorporates the same herein, and claims all benefits accruing under 35 U.S.C. §119 from an application for *Paper Feeding Method Of An Image Forming Apparatus* earlier filed in the Korean Industrial Property Office on 2 Nov. 1994 and there assigned Ser. No. 28691/1994.

BACKGROUND OF THE INVENTION

The present invention relates to a paper feeding method of an image forming apparatus, and more particularly to a paper feeding method of an image forming apparatus having means for sensing the feeding state of paper fed from a manual paper feeding device and an automatic paper feeding device.

Generally, in an image forming apparatus such as copier, facsimile, printer or the like, the paper feeding device for feeding paper is an important component. The electrophotographic developing method is widely used not only for copiers, but also for printers, facsimiles, and other image forming mechanisms. Certain image forming apparatus is equipped with both a manual paper feeding mode and an automatic paper feeding mode.

One prior art reference that provides both a manual and automatic paper feeding operation is found in U.S. Pat. No. 5,216,472 entitled *Printer With Paper Supplying Device* issued to Muto et al. on 1 Jun. 1993. In Muto et al. '472, a printer is provided with a manual insertion paper detecting sensor for detecting whether or not paper inserted from a manual insertion tray is in a manual supplying path, and an automatic insertion paper detection sensor for detecting whether or not paper supplied from a paper cassette is in an automatic insertion path. A light emitting diode (LED) is activated when paper is not detected by both the manual insertion paper detection sensor and the automatic insertion paper detection sensor. While conventional art, such as Muto et al. '472, has merit in its own right, we believe that an improved paper feeding method for providing both a manual and automatic paper feeding operation can be contemplated.

SUMMARY OF THE INVENTION

Accordingly, it is an object of the present invention to provide an improved paper feeding method for an image forming apparatus.

It is another object to provide a paper feeding method for an image forming apparatus for preventing printing errors attributable to paper being manually fed during an automatic paper feeding mode.

It is still another object to provide a paper feeding method for an image forming apparatus having a sensor capable of sensing the feeding state of paper fed from a manual paper feeding device and an automatic paper feeding device.

It is yet another object to provide a paper feeding method for an image forming apparatus capable of sensing manually and automatically fed paper and enabling performance of page synchronization during a printing operation.

These and other objects can be achieved in accordance with the present invention with a paper feeding method for an image forming apparatus having a sensing device for sensing the feeding state of paper fed from a manual paper feeding device and an automatic paper feeding device. The method contemplates picking up and feeding paper from the automatic paper feeding device in response to a printing command during an automatic paper feeding mode, determining whether or not a predetermined time period has elapsed after picking up the paper, determining whether the sensing device has sensed the presence of the paper before the predetermined time period has elapsed, and providing an error message indicating the occurrence of a paper feeding error state when the sensing device senses the presence of the paper before the predetermined time period has elapsed.

BRIEF DESCRIPTION OF THE DRAWINGS

A more complete appreciation of the present invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
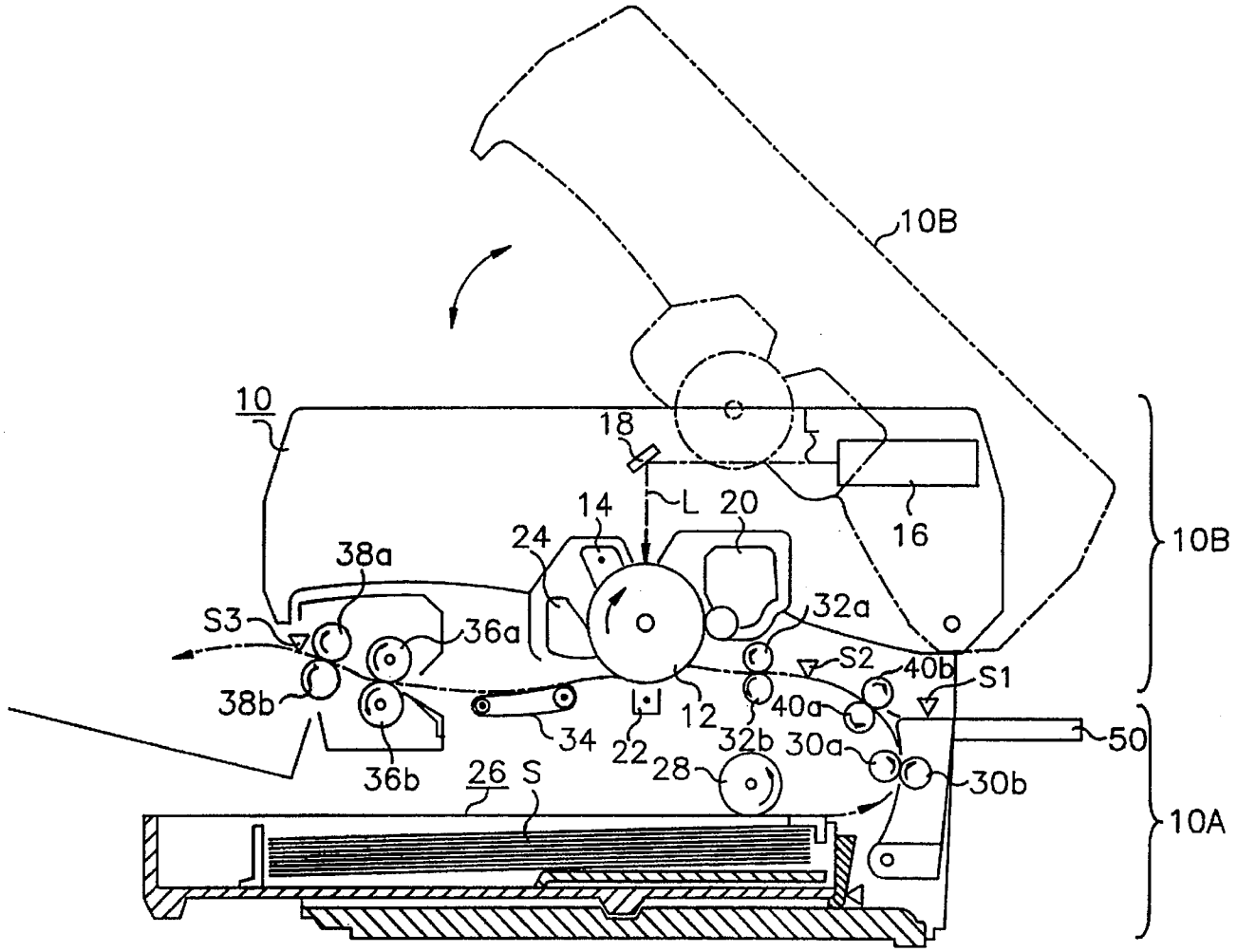
FIG. 1 (RELATED ART)
FIG. 1 is an elevational view abstractly illustrating construction of a conventional paper feeding device in a general image forming apparatus.

Turning now to the drawings and referring to FIG. 1, an abstract representation of a generic laser beam printer is shown. The printer shown in FIG. 1 comprises a housing 10 having a body 10A and a cover 10B which can be rotatably opened and closed relative to body 10A. A charger 14 forms a uniform charge layer on an outer surface of a photosensitive drum 12. A laser scanner unit 16 generates laser beam L corresponding to image data to expose photosensitive drum 12 through a laser reflecting mirror 18, thereby forming an electrostatic latent image on the outer surface of photosensitive drum 12. A developing unit 20 transmits developing material to the electrostatic latent image formed on photosensitive drum 12. A pick-up roller 28 (also known as a feed roller) picks up and feeds the paper S stacked in a paper cassette 26. First and second sets of feeding rollers 30*a*, 30*b* and 40*a*, 40*b* feed the paper S provided by pick-up roller 28 to register rollers 32*a* and 32*b*. Register rollers 32*a* and 32*b* register the paper fed by first and second sets of feeding rollers 30*a*, 30*b* and 40*a*, 40*b*, or the paper manually fed by a manual paper feeding device 50 and the second set of feeding rollers 40*a* and 40*b*. A transfer unit 22 transfers the developing material formed on photosensitive drum 12 onto the paper. A cleaner 24 removes the residual developing material from the surface of photosensitive drum 12 after the transfer of the developing material. A conveyor belt 34 feeds the paper from transfer unit 22 to fixing rollers 36*a* and 36*b*. Fixing rollers 36*a* and 36*b* subsequently affix the developing material onto the paper. Fixing rollers 36*a* and 36*b* are heated by a heating lamp (not shown) installed within the primer, to enable fixation of the developing material onto the paper. Delivery rollers 38*a* and 38*b* eject the image-formed paper to the exterior of the printer.

Generally, sensors are installed in the printer to sense the operational status of each portion of the printer or the feeding state of the paper. In FIG. 1, a first sensor S1 is placed along the paper conveyance path between manual paper feeding device 50 and the second set of feeding rollers 40*a* and 40*b* to sense the feeding state of the paper fed from manual paper feeding device 50 to the second set of feeding rollers 40*a* and 40*b*. A second sensor S2 is placed along the paper conveyance path between the second set of feeding rollers 40*a* and 40*b* and register rollers 32*a* and 32*b* to sense the feeding state of the paper fed from the second set of feeding rollers 40*a* and 40*b* to register rollers 32*a* and 32*b*. A third sensor S3 is placed along the paper ejection path adjacent to delivery rollers 38*a* and 38*b* to sense the delivery status of the paper ejected to the exterior of the printer.

Referring again to the printer represented by FIG. 1, a paper feeding method of a conventional image forming apparatus will now be described. If a user inserts paper into manual paper feeding device 50, first sensor S1 senses that the paper has been fed and the printer perceives the feeding state as a manual feeding state. Thereafter, the printer refrains from driving pick-up roller 28 even though the printing command is received from a personal computer (not shown), but instead feeds the paper fed from manual paper feeding device 50. In addition, if the leading edge of the paper is passed to second sensor S2 through the second set of feeding rollers 40*a* and 40*b*, a page synchronization signal PSYNC is generated to synchronize the image data with the leading edge of the paper. After a lapse of a predetermined time period, laser scanner unit 16 forms the image on photosensitive drum 12 in accordance with the page synchronization signal PSYNC, thereby enabling the printing operation.

The paper feeding method for the conventional image forming apparatus described above, however, is disadvantageous since two sensors are necessarily employed. That is, one for sensing whether or not the paper is manually fed, and the other for synchronizing the leading edge of the paper with the starting point of the image data.

In order to improve the conventional image forming apparatus of FIG. 1, an image forming apparatus provided with only one sensor for sensing manually input paper and performing page synchronization has been recently disclosed by the Hewlett-Packard Corp.

Figure 2:
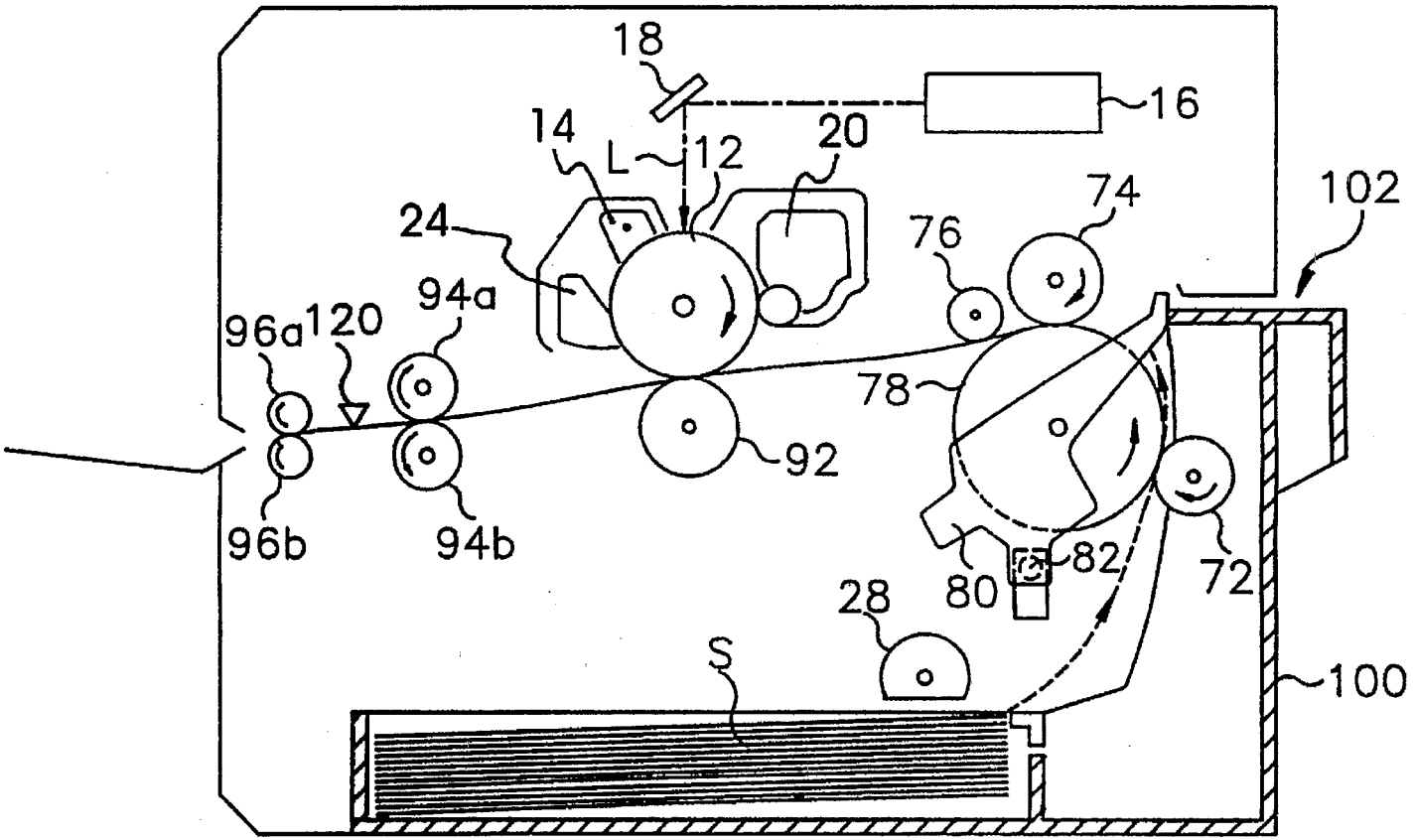
FIG. 2 is an elevational view abstractly illustrating construction of a paper feeding device in an image forming apparatus having a single sensor capable of sensing manually fed paper and performing page synchronization.

FIG. 2 shows the construction of the paper feeding device of an image forming apparatus capable of sensing manually input paper and performing page synchronization with a single sensor.

FIG. 2 has a similar construction to FIG. 1, except for the position of each sensor and the components used for feeding individual cut sheets of paper to a transfer roller 92. Transfer roller 92 corresponds to transfer unit 22 of FIG. 1. Pick-up roller 28 picks up and feeds the paper S stacked in a paper cassette 100. A feeding roller 78 and first, second and third idle rollers 72, 74 and 76 feed the paper fed from pick-up roller 28 to transfer roller 92. An actuator 80 is displaced by the paper S fed by feeding roller 78 and first idle roller 72, and a feeding sensor 82 (i.e., a photosensor) senses the presence of the paper S through the movement of actuator 80. Actuator 80 is also displaced by the paper S fed from a manual paper feeding slot 102 of paper cassette 100. A delivery sensor 120 (i.e., a photosensor) senses the presence of the paper fed from fixing rollers 94*a* and 94*b* to delivery rollers 96*a* and 96*b*.

Figure 3A:
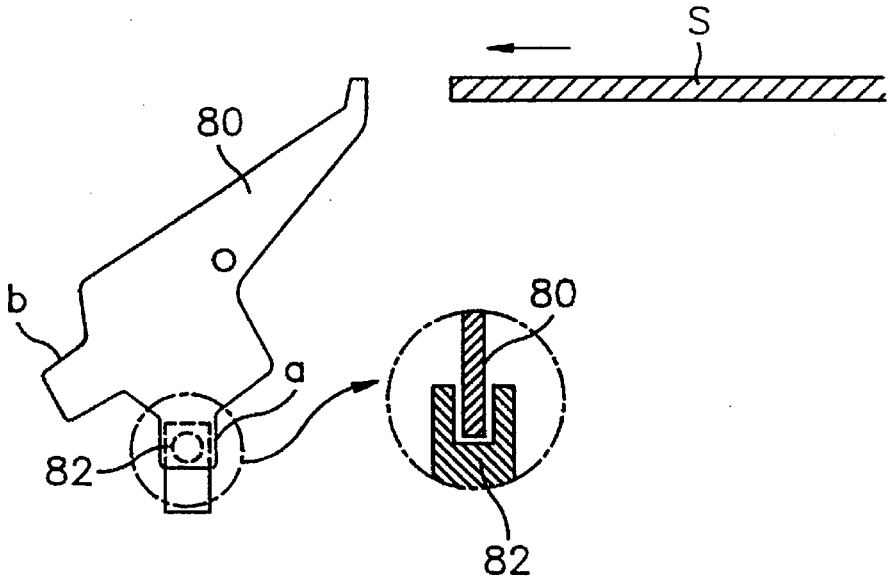
FIGS. 3A through 3F are diagrams illustrating paper feed sensing steps of an actuator of FIG. 2.
Figure 3B:
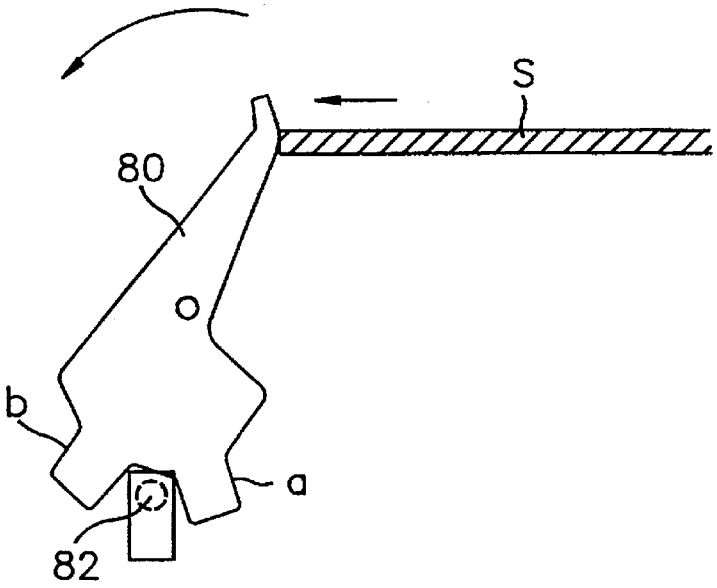
Figure 3C:
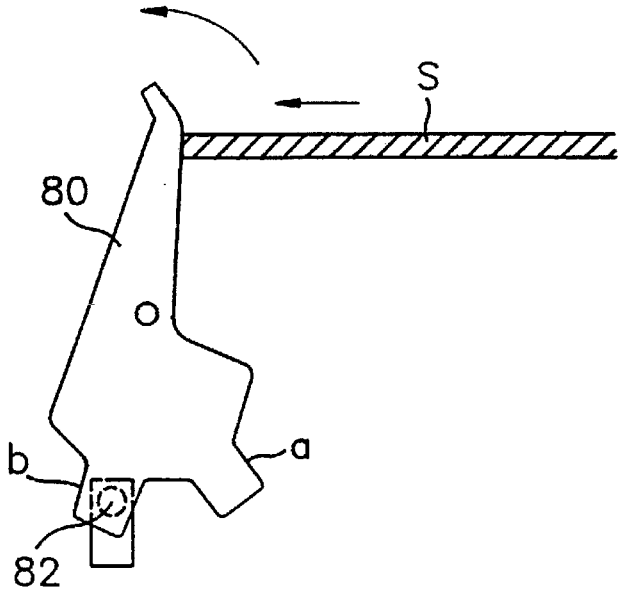
Figure 3D:
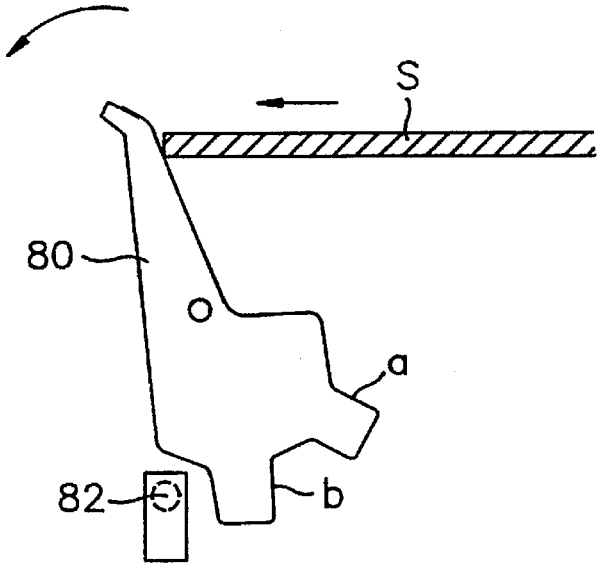
Figure 3E:
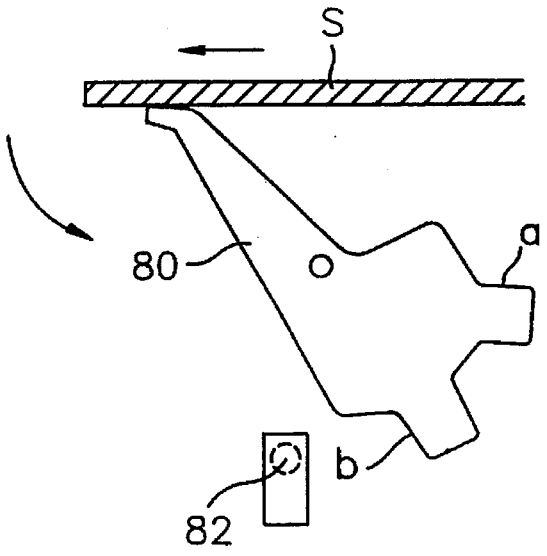
Figure 3F:
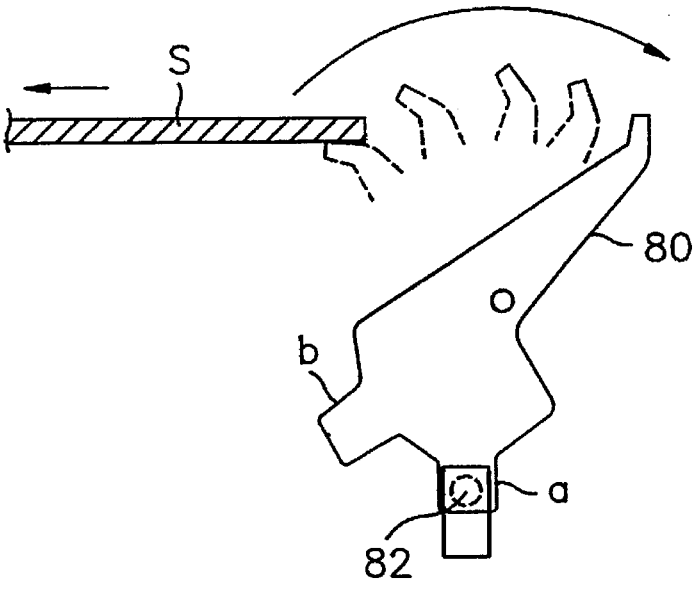

FIGS. 3A to 3F are diagrams showing the individual paper feed sensing steps of actuator 80 in FIG. 2. As shown in FIG. 3A, in an initial state before the paper S reaches actuator 80, feeding sensor 82 maintains an off state by sensing the portion a of actuator 80. Thereafter, if actuator 80 rotates counter-clockwise around a fixed shaft in response to the feeding of paper S, as shown in FIG. 3B, the portion a of actuator 80 is separated from the sensing region of feeding sensor 82. Accordingly, feeding sensor 82 senses that the paper S is pushing actuator 80, and switches to an on-state. In FIG. 3C, the portion b of actuator 80 is placed in the sensing region of feeding sensor 82 as the paper S continues to be fed, and feeding sensor 82 switches to the off-state again. In FIG. 3D, the portion b of actuator 80 is separated from feeding sensor 82 in response to the feeding of the paper, and feeding sensor 82 switches to the on-state again. As shown in FIG. 3E, actuator 80 is positioned just below the paper S. As shown in FIG. 3F, when the paper S completely passes actuator 80, actuator 80 rotates clockwise and returns to its original position, and feeding sensor 82 switches to the off-state based on the position of portion a of actuator 80.

Figure 4:
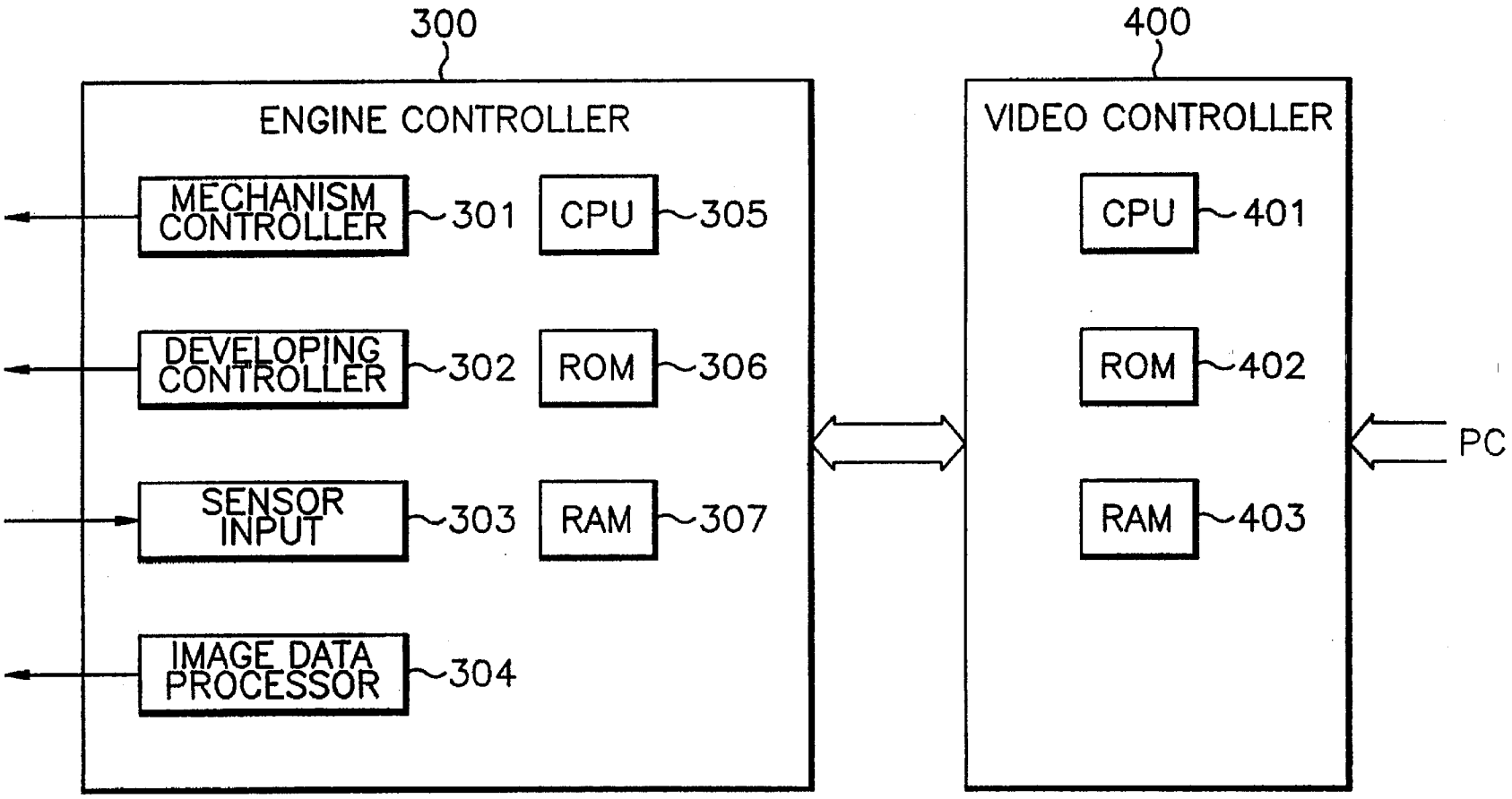
FIG. 4 is a block diagram illustrating construction of a control portion in the image forming apparatus of FIG. 2.

FIG. 4 is a block diagram illustrating the construction of a control portion in the image forming apparatus of FIG. 2. In FIG. 4, an engine controller 300 may be constructed with a mechanism controller 301, a developing controller 302, a sensor input 303, an image data processor 304, a central processing unit 305 (CPU), a read only memory (ROM) 306, and a random access memory (RAM) 307. Mechanism controller 301 controls motors and each component shown in FIG. 2. Developing controller 302 controls the charging, developing and transfer operations. Sensor input 303 receives sensing signals provided from each sensor. Image data processor 304 controls laser scanner unit 16 to expose photosensitive drum 12 corresponding to the image data to be printed.

In FIG. 4, a video controller 400 represented as a microprocessor having a central processing unit (CPU) 401, a read only memory (ROM) 402, and a random access memory (RAM) 403 receives the image data from an external input source, such as a personal computer (PC) and then processes the image data to be printed in accordance with the program stored in read only memory (ROM) 402. Read only memory (ROM) 402 in video controller 400 also includes a font read only memory (ROM).

A printing operation of the image forming apparatus of FIG. 2 will be described with reference to FIGS. 2 through 4.

Referring to the manual paper feeding operation, if a user inserts an individual cut sheet of paper S into manual paper feeding slot 102, the portion a of actuator 80 is pushed by the leading edge of the paper S and becomes separated from the sensing region of feeding sensor 82. Thus, if the output of feeding sensor 82 switches to the on-state before the printing command is received, engine controller 300 senses that the paper S is fed through manual paper feeding slot 102, and then drives a motor (not shown), thus feeding the paper S so that its leading edge engages second idle roller 74. The stop state of engine controller 300 is shown in FIG. 3C. At this time, as the portion b of actuator 80 is placed within the sensing region, feeding sensor 82 switches to the off-state.

Then, in the stop state shown in FIG. 3C, engine controller 300 awaits input of the printing command from an external source. When the printing command is received from the external source and a print preparation step is completed, engine controller 300 begins to feed the paper S. That is, paper S begins to be fed and the portion b of actuator 80 becomes separated from the sensing region of feeding sensor 82, as shown in FIG. 3D. Hence, feeding sensor 82 switches to the on-state and outputs a corresponding sensing signal to engine controller 300. In response to the sensing signal, engine controller 300 outputs the page synchronization signal (SYNC) for synchronizing the leading edge of the paper S with the image data, and after a lapse of a predetermined time period, controls operation of laser scanner unit 16.

Engine controller 300 senses when the trailing edge of the paper S has completely passed actuator 80 by checking the status of the sensing signal generated from feeding sensor 82 when actuator 80 returns to its original position. After a lapse of the predetermined time period, engine controller 300 controls laser scanner unit 16 to synchronize the image data with the trailing edge of the paper S. That is, in a case where the paper S is shorter than a normal paper size and the image data is of normal paper size, engine controller 300 controls laser scanner unit 16 so that the exposure operation corresponds to the actual size of the paper, thus preventing unnecessary toner consumption and contamination in the printer. Such an exposure control method is disclosed in Korean Patent Applications No. 92-2487 and No. 92-4764.

Referring to the cassette feeding operation, when a single cut sheet of paper S is inserted through manual paper feeding slot 102 and the portion a of actuator 80 is not separated from the sensing region of feeding sensor 82, engine controller 300 senses that the printer is in the cassette feeding state, (i.e., the automatic paper feeding mode). That is, if the printing command is received in the cassette feeding state, engine controller 300 controls the driving of respective components, thereby picking up one sheet of paper S from paper cassette 100 and then printing the image data on the paper S after the paper passes through the first to third idle rollers 72, 74 and 76. The operation of synchronizing the leading edge of the paper S with the image data is identical to that in the manual paper feeding mode.

Figure 5:
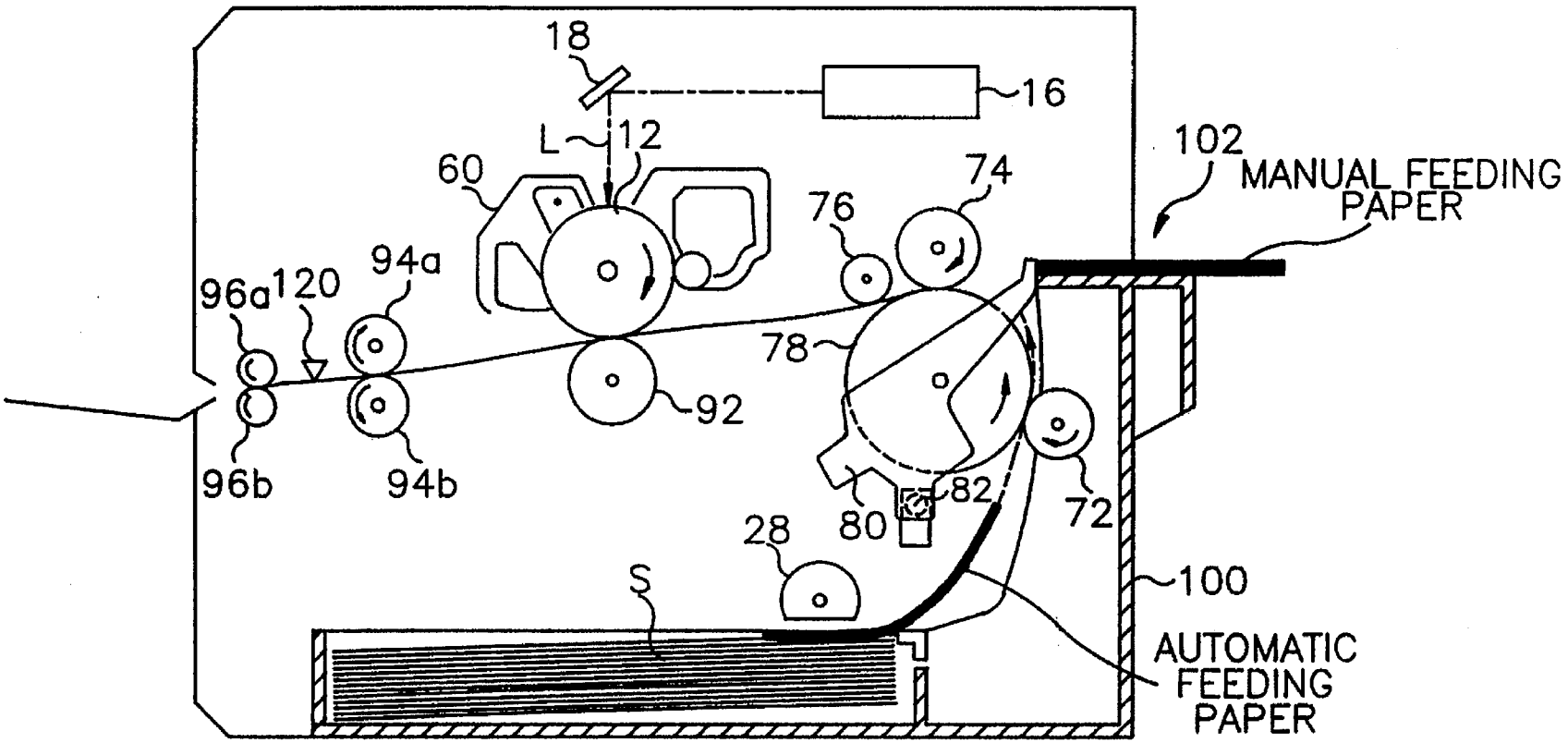
FIG. 5 (RELATED ART)
FIG. 5 is a diagram illustrating the state where a paper feeding error occurs in a conventional paper feeding method.

As shown in FIG. 5, the paper feeding method described above has a problem in that if the paper S is inserted into manual paper feeding slot 102 before the leading edge of the paper S provided from paper cassette 100 reaches actuator 80 in the automatic paper feeding mode, two sheets of papers are simultaneously fed. This often occurs due to the carelessness of the user, and poses a serious problem since the printing operation is performed without displaying any error message.

The image forming apparatus performing the present invention can be constructed in the same manner as that shown in FIGS. 2 through 4, and a preferred embodiment of the present invention will now be described with reference to FIGS. 2 through 6B.

Figure 6A:
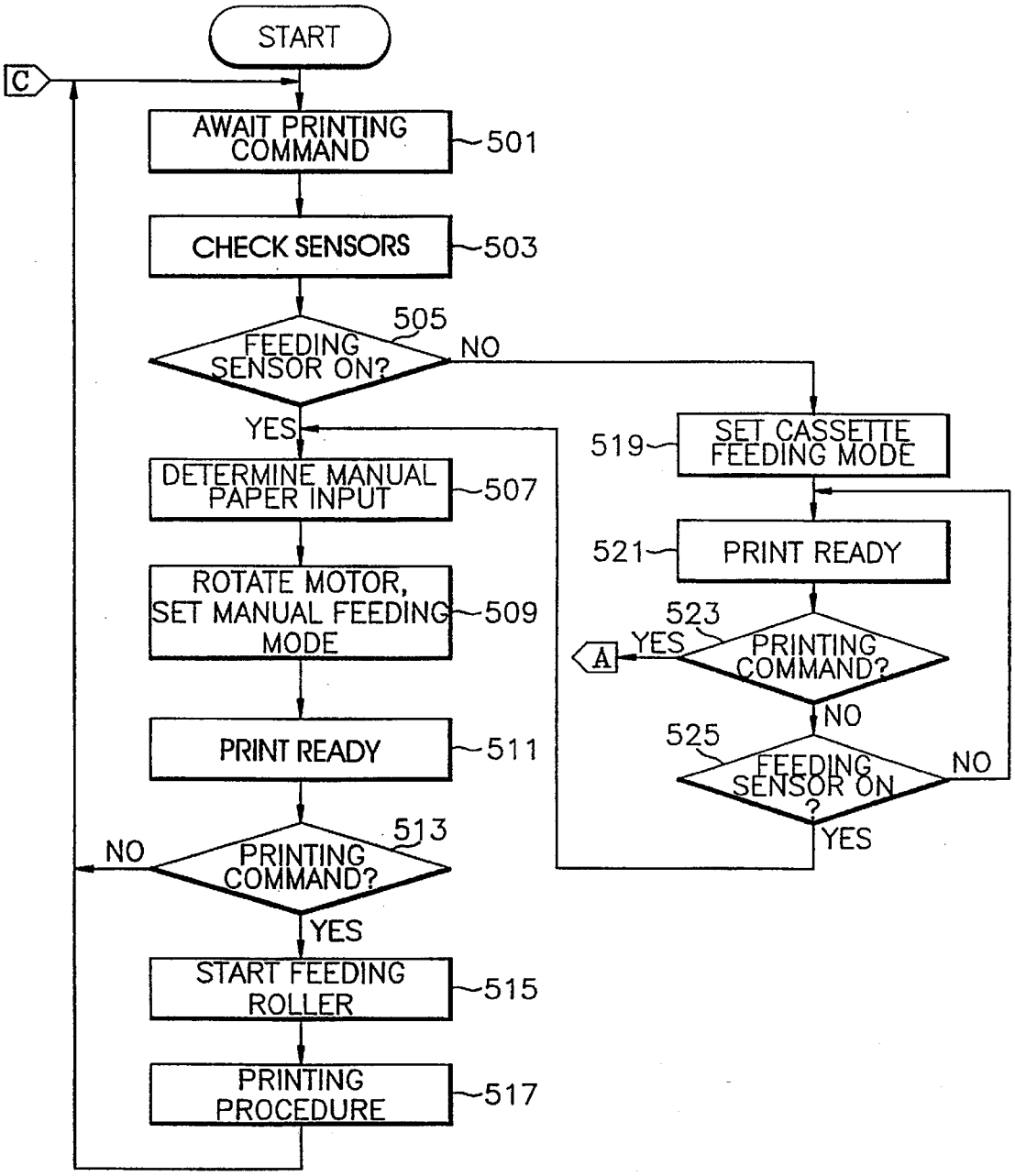
FIGS. 6A and 6B are flow charts illustrating the printing and feeding operations of an engine controller constructed as a preferred embodiment according to the principles of the present invention.
Figure 6B:
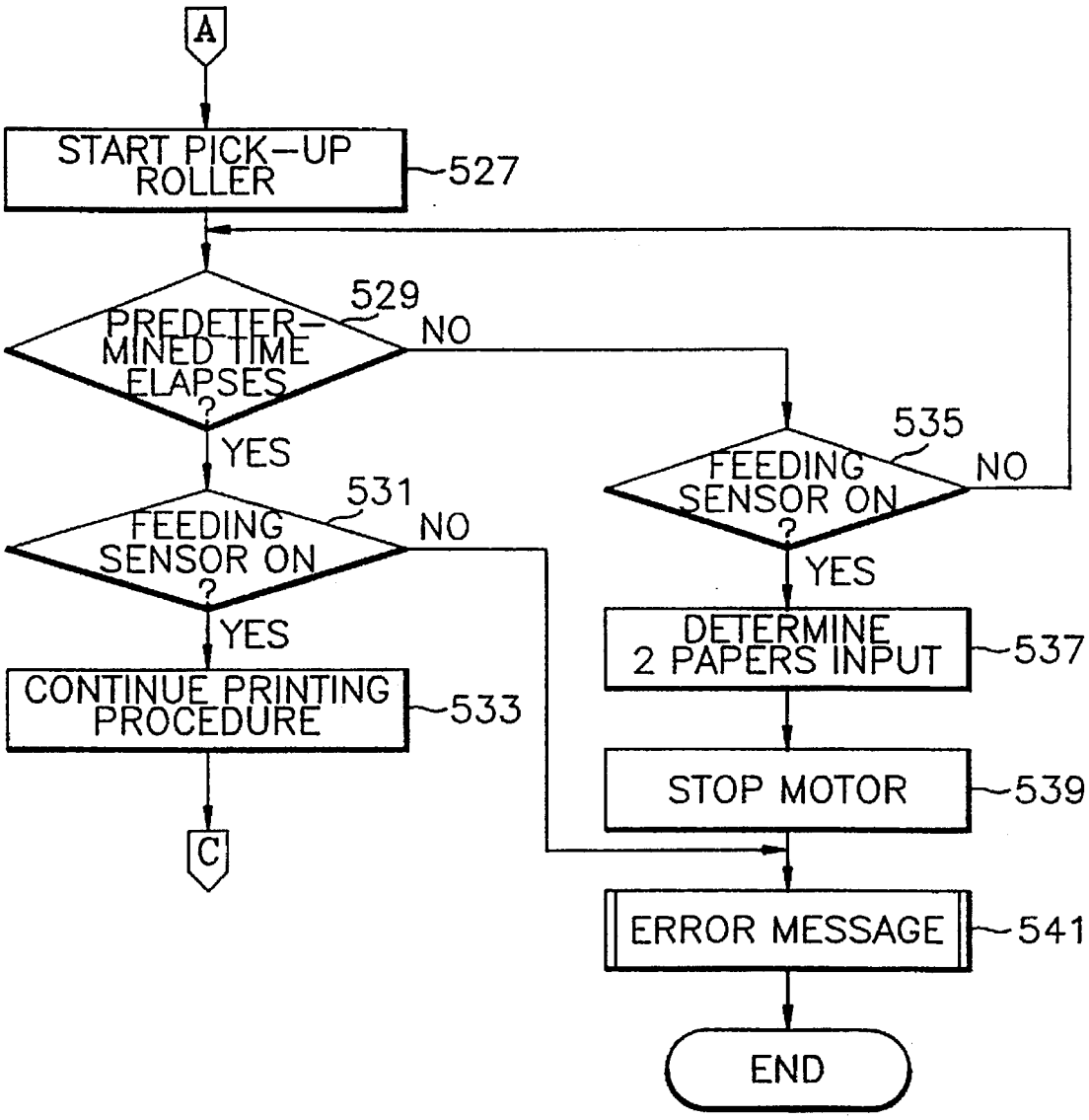

FIGS. 6A and 6B are flow charts illustrating the printing and feeding operations of an engine controller according to a preferred embodiment of the present invention.

After the printer is turned on, engine controller 300 awaits the printing command from video controller 400, in step 501. In step 503, engine controller 300 checks for inputs provided from the various sensors in the printer. In step 505, engine controller 300 detects whether or not feeding sensor 82 is in the on-state. If feeding sensor 82 is in the on-state, engine controller 300 perceives that the present feeding state is a manual paper feeding state, in step 507. In step 509, when actuator 80 is in the position shown in FIG. 3C, engine controller 300 rotates a motor (not shown) to arrange and provide passage of the paper S inserted through manual paper feeding slot 102, and then sets the paper feeding mode to the manual paper feeding mode. In step 511, engine controller 300 establishes a print ready state. In step 513, engine controller 300 checks whether or not the printing command is received from video controller 400. If the printing command is received, engine controller 300 starts rotation of feeding roller 78 to feed the paper, in step 515, and then performs the printing procedure, in step 517. After completion of the printing procedure, engine controller 300 returns to step 501 and repeats the above steps.

If, in step 505, feeding sensor 82 is in the off-state, engine controller 300 sets the paper feeding mode to a cassette feeding mode, in step 519. Thereafter, engine controller 300 maintains the print ready state, in step 521, and checks whether or not the printing command is received, in step 523. If the printing command is not received, engine controller 300 checks, in step 525, whether or not feeding sensor 82 is in the on-state. If feeding sensor 82 is in the on-state, engine controller 300 proceeds to step 507. If feeding sensor 82 is not in the on-state, engine controller 300 returns to step 521.

If the printing command is received in step 523, engine controller 300 starts rotation of pick-up roller 28 to pick-up paper S within paper cassette 100, in step 527. In step 529, engine controller 300 determines whether or not a predetermined time period has elapsed. Here, the predetermined time period refers to the amount of time required for the paper S picked-up by pick-up roller 28 to reach the point where feeding sensor 82 is switched to the on-state. If the predetermined time period has not elapsed, engine controller 300 detects whether or not feeding sensor 82 is in the on-state, in step 535. If feeding sensor 82 is not in the on-state before the predetermined time period elapses, engine controller 300 returns to step 529. If feeding sensor 82 is in the on-state before the predetermined time period elapses, engine controller 300 perceives that two sheets of papers are being respectively fed from the manual and cassette paper feeding devices, in step 537. Then, engine controller 300 interrupts operation of the motor that provides passage of the paper S through the printer, in step 539, and transmits the error message, in step 541.

If, in step 529, the predetermined time period has elapsed, engine controller 300 proceeds to step 531 where it detects whether or not feeding sensor 82 is in the on-state. If feeding sensor 82 switches to the on-state after the predetermined time period elapses, in step 531, engine controller 300 continues to perform the printing procedure, in step 533, and then returns to step 501. However, if the feeding sensor 82 is not in the on-state, in step 531, engine controller 300 proceeds to step 541 and transmits the error message. When the error message is generated in step 541 after step 531, this represents that the paper S has not reached the point where feeding sensor 82 is switched to the on-state even after the predetermined time period has elapsed. This typically indicates that a paper jam has occurred. Alternatively, when the error message is generated in step 541 after step 539, this represents that two sheets of papers are being simultaneously fed. In step 541, two different error messages may be transmitted according to respective error states, or only one error message may be transmitted.

Accordingly, the present invention is advantageous in that it is possible to prevent an unnecessary printing error by sensing paper that is accidentally fed manually by the user during the cassette paper feeding mode.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A paper feeding method for an image forming apparatus having means for sensing a feeding state of paper fed from a manual paper feeding means and an automatic paper feeding means, said method comprising the steps of:

picking up the paper from said automatic paper feeding means in response to a printing command during an automatic paper feeding mode of said image forming apparatus and feeding the paper for passage through said image forming apparatus;

determining whether a predetermined time period has elapsed after picking up the paper, said predetermined time period corresponding an amount of time normally experienced before said sensing means detects a paper fed from said automatic paper feeding means;

determining whether said sensing means senses a presence of the paper; and when said sensing means senses the presence of the paper before said predetermined time period has elapsed, providing output of an error message indicating a paper feeding error.

2. The paper feeding method as claimed in claim 1, wherein said paper feeding error represents a condition where two sheets of paper are being simultaneously fed from said manual paper feeding means and said automatic paper feeding means, respectively.

3. The paper feeding method as claimed in claim 2, further comprising a step of interrupting operation of a motor providing the passage of the paper through said image forming apparatus when said sensing means senses the presence of the paper before said predetermined time period has elapsed.

4. The paper feeding method as claimed in claim 1, further comprising a step of interrupting operation of a motor providing the passage of the paper through said image forming apparatus when said sensing means senses the presence of the paper before said predetermined time period has elapsed.

5. A paper feeding method for an image forming apparatus having means for sensing a feeding state of paper fed from a manual paper feeding means and an automatic paper feeding means and for performing page synchronization during a printing operation, said method comprising the steps of:

picking up the paper from said automatic paper feeding means in response to a printing command during an automatic paper feeding mode of said image forming apparatus and feeding the paper for passage through said image forming apparatus;

determining whether said sensing means senses a presence of the paper after picking up the paper;

performing said printing operation when said sensing means senses the presence of the paper after a predetermined time period has elapsed, said predetermined time period corresponding to an amount of time normally experienced before said sensing means detects a paper fed from said automatic paper feeding means;

providing output of a first error message indicating a first paper feeding error when said sensing means senses the presence of the paper before said predetermined time period has elapsed; and providing output of a second error message indicating a second paper feeding error when said sensing means fails to sense the presence of the paper after said predetermined time period has elasped.

6. The paper feeding method as claimed in claim 5, wherein said first paper feeding error represents a first condition where two sheets of paper are being simultaneously fed from said manual paper feeding means and said automatic paper feeding means, respectively.

7. The paper feeding method as claimed in claim 6, wherein said second paper feeding error represents a second condition where the paper is jammed within said image forming apparatus.

8. The paper feeding method as claimed in claim 5, wherein said second paper feeding error represents a condition where the paper is jammed within said image forming apparatus.

9. The paper feeding method as claimed in claim 5, further comprising a step of interrupting operation of a motor providing the passage of the paper through said image forming apparatus when said sensing means senses the presence of the paper before said predetermined time period has elapsed.

10. The paper feeding method as claimed in claim 7, further comprising a step of interrupting operation of a motor providing the passage of the paper through said image forming apparatus when said sensing means senses the presence of the paper before said predetermined time period has elapsed, said predetermined time period corresponding to an amount of time normally experienced before said sensing means detects a paper fed from said automatic paper feeding means.

11. An image forming apparatus, comprising:

manual paper feeding means for providing manual input of paper into said image forming apparatus for a printing operation during a manual paper feeding mode of said image forming apparatus;

automatic paper feeding means for providing automatic input of the paper into said image forming apparatus for said printing operation during an automatic paper feeding mode of said image forming apparatus;

control means for enabling performance of said printing operation in response to a printing command, said control means determining whether a predetermined time period has elapsed in response to said printing command during said automatic paper feeding mode;

sensing means for detecting a presence of the paper as the paper passes through said image forming apparatus during said printing operation; and said control means determining that a first paper feeding error has occurred when said sensing means detects the presence of the paper before said predetermined time period has elapsed said predetermined time period corresponding to an amount of time it normally takes a paper fed from said automatic paper feeding means to be detected by said sensing means.

12. The image forming apparatus as claimed in claim 11, wherein said first paper feeding error represents a first condition where two sheets of paper are being simultaneously input into said image forming apparatus from said manual paper feeding means and said automatic paper feeding means, respectively.

13. The image forming apparatus as claimed in claim 12, further comprised of said control means continuing said printing operation when said sensing means detects the presence of the paper after said predetermined time period has elapsed.

14. The image forming apparatus as claimed in claim 13, further comprised of said control means determining that a second paper feeding error has occurred when said sensing means fails to detect the presence of the paper after said predetermined time period has elapsed.

15. The image forming apparatus as claimed in claim 14, wherein said second paper feeding error represents a second condition where the paper is jammed within said image forming apparatus.

16. The image forming apparatus as claimed in claim 12, further comprised of said control means determining that a second paper feeding error has occurred when said sensing means fails to detect the presence of the paper after said predetermined time period has elapsed.

17. The image forming apparatus as claimed in claim 16, wherein said second paper feeding error represents a second condition where the paper is jammed within said image forming apparatus.

18. A sheet feeding method, comprising the steps of:

responding to a printing command during a cassette feeding mode of an image forming apparatus by extracting a sheet of a printable medium from a cassette feeding device containing a stack formed by a plurality of cut sheets of the printable medium while said cassette feeding device is installed within said image forming apparatus having a sensor for detecting a feeding state of sheets of the printable medium fed from said cassette feeding device and from a manual feeding device positioned to individually feed separated sheets of the printable medium directly into said image forming apparatus, and by feeding the sheet for passage through said image forming apparatus;

commencing a timing operation upon the extraction of the sheet from said cassette feeding device;

determining from said timing operation, whether a predetermined time period has elapsed since the sheet was extracted from said cassette feeding device;

determining whether said sensor is turned on; and when said sensor is turned on before said predetermined time period has elapsed, providing output of an error message indicating a sheet feeding error.

19. The sheet feeding method as claimed in claim 18, wherein said sheet feeding error represents a condition where two sheets of the printable medium are being simultaneously fed from said manual feeding device and said cassette feeding device, respectively.

20. The sheet feeding method as claimed in claim 18, further comprising a step of interrupting operation of a motor providing the passage of the sheet through said image forming apparatus when said sensor is turned on before said predetermined time period has elapsed.

* * * * *